US009682412B2

(12) United States Patent
Arai et al.

(10) Patent No.: US 9,682,412 B2
(45) Date of Patent: Jun. 20, 2017

(54) HEMMING FINISHING PLIERS

(71) Applicant: HONDA MOTOR CO., LTD., Minato-Ku, Tokyo (JP)

(72) Inventors: Hideki Arai, Tokyo (JP); Hiroyuki Hanada, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 77 days.

(21) Appl. No.: 14/296,625

(22) Filed: Jun. 5, 2014

(65) Prior Publication Data

US 2014/0359988 A1 Dec. 11, 2014

(30) Foreign Application Priority Data

Jun. 7, 2013 (JP) ..... 2013-121042

(51) Int. Cl.
*B21D 39/02* (2006.01)
*B25B 7/02* (2006.01)
*B25B 7/08* (2006.01)

(52) U.S. Cl.
CPC ..... *B21D 39/021* (2013.01); *B21D 39/025* (2013.01); *B25B 7/02* (2013.01); *B25B 7/08* (2013.01); *Y10T 29/53791* (2015.01)

(58) Field of Classification Search
CPC .... B21D 39/021; B21D 39/025; B25B 31/00; B25B 7/08; B25B 7/02; Y10T 29/539; Y10T 29/53791
See application file for complete search history.

(56) References Cited

U.S. PATENT DOCUMENTS 902,570 A * 11/1908 Ellis ..... B25B 7/12 294/104
1,983,519 A * 12/1934 Choate ..... B25B 7/02 72/409.18

(Continued)

FOREIGN PATENT DOCUMENTS

JP 37-33077 U 12/1962
JP S57-108863 U 7/1982

(Continued)

OTHER PUBLICATIONS

Official Communications dated Oct. 15, 2014 issued in the corresponding Japanese Patent Application No. 2013-121042.

*Primary Examiner* — Joseph J Hail
*Assistant Examiner* — Arman Milanian
(74) *Attorney, Agent, or Firm* — Carrier Blackman & Associates, P.C.; William D. Blackman; Joseph P. Carrier

(57) ABSTRACT

Hemming finishing pliers press and thereby bring a folded portion of a panel into close contact with an inner surface side of the panel facing the folded portion, by a clamping action of first and second holding arms. A pressure receiving plate for supporting an outer surface of the panel is provided in a tip end portion of the first holding arm. A pressing claw for pressing the folded portion against the panel supported by the plate is provided in a tip end portion of the second holding arm. A pressure receiving surface of the plate facing the outer surface of the panel is set wider than a pressing surface of the claw facing the folded portion. A supporting wall for supporting a flexed part of the folded portion is formed in the plate. Accordingly, the pliers enable efficient hemming finishing without requiring a skill.

1 Claim, 6 Drawing Sheets

(56) References Cited

U.S. PATENT DOCUMENTS 2,143,339 A * 1/1939 Wiese ..... B21D 39/025 81/342
3,180,128 A * 4/1965 Faulkner ..... B21D 19/00 72/409.08
3,184,838 A * 5/1965 Johnson ..... B25B 7/02 29/271
3,364,724 A * 1/1968 Schmidt ..... B21D 19/08 72/409.18
3,602,032 A * 8/1971 Skintzis ..... B21D 39/021 173/131
3,961,518 A * 6/1976 Osbolt ..... B21D 39/02 72/409.13
4,318,211 A * 3/1982 Hoskinson ..... B21D 39/025 29/243.5
4,386,543 A * 6/1983 Walker, Jr. ..... B25B 7/02 269/265
4,713,959 A * 12/1987 Bennett ..... B21D 39/03 29/243.5
5,020,202 A * 6/1991 Turrell ..... B25B 31/00 29/243.56
5,095,732 A * 3/1992 Bootka ..... B21D 39/021 29/243.58
5,456,144 A * 10/1995 Dahl ..... B25B 7/02 269/6
5,661,886 A * 9/1997 Smith ..... B25B 7/02 29/243.5
6,280,184 B1 * 8/2001 Hamilton ..... A61C 7/04 433/159
6,453,531 B1 * 9/2002 Krass ..... B25B 5/163 29/229
D542,608 S * 5/2007 Romsburg ..... D7/368
D567,376 S * 4/2008 Golden ..... D24/153
D581,231 S * 11/2008 Williams ..... D8/52
7,611,178 B2 * 11/2009 Romsburg, Sr. ..... A47J 45/00 294/31.1

FOREIGN PATENT DOCUMENTS

JP 2-85563 U 7/1990
JP 2003-170363 A 6/2003

* cited by examiner

HEMMING FINISHING PLIERS

CROSS REFERENCES TO RELATED APPLICATIONS

The present application claims priority under 35 U.S.C. §119 to Japanese Patent Application No. 2013-121042 filed Jun. 7, 2013 the entire contents of which are hereby incorporated by reference.

BACKGROUND OF THE INVENTION

Field of the Invention

The present invention relates to pliers for use in hemming finishing of a folded portion formed at an end edge portion of a panel, in particular, relates to hemming finishing pliers comprising: first and second plier bodies connected together to be turnable relative to each other in mutually intersecting intermediate portions thereof by use of a pivot shaft, the first and second plier bodies including first and second holding arms formed on one-end sides of the first and second plier bodies, and first and second handles formed on opposite-end sides of the first and second plier bodies and configured to open and close the first and second holding arms, in which the pliers press and thereby bring a folded portion of a panel into close contact with an inner surface side of the panel facing the folded portion, by a clamping action of the first and second holding arms.

Description of the Related Art

As disclosed in Japanese utility model application laid-open No. 57-108863, in a conventional method of manually performing hemming in an end edge portion of a panel, a folded portion is formed in the end edge portion of the panel by using hemming pliers, and hemming finishing is performed for driving the folded portion to closely attach it to an inner surface side of the panel by using a hammer and a patch metal.

SUMMARY OF THE INVENTION

However, the hemming finishing using the hammer and the patch metal requires a skill and is also inefficient.

The present invention has been made in view of the aforementioned circumstance. An object of the present invention is to provide hemming finishing pliers which enable efficient hemming finishing without requiring a skill.

In order to achieve the object, according to a first aspect of the present invention, there is provided hemming finishing pliers comprising: first and second plier bodies connected together to be turnable relative to each other in mutually intersecting intermediate portions thereof by use of a pivot shaft, the first and second plier bodies including first and second holding arms formed on one-end sides of the first and second plier bodies, and first and second handles formed on opposite-end sides of the first and second plier bodies and configured to open and close the first and second holding arms, in which the pliers press and thereby bring a folded portion of a panel into close contact with an inner surface side of the panel facing the folded portion, by a clamping action of the first and second holding arms, a pressure receiving plate for supporting an outer surface of the panel is provided in a tip end portion of the first holding arm, a pressing claw for pressing the folded portion against the panel supported by the pressure receiving plate is provided in a tip end portion of the second holding arm, a pressure receiving surface of the pressure receiving plate facing the outer surface of the panel is set wider than a pressing surface of the pressing claw facing the folded portion, and a supporting wall for supporting a flexed part of the folded portion is formed in the pressure receiving plate.

According to the first aspect of the present invention, the pressure receiving plate for supporting the outer surface of the panel is provided in the tip end portion of the first holding arm. Moreover, the pressing claw for pressing the folded portion against the panel supported by the pressure receiving plate is provided in the tip end portion of the second holding arm, and the pressure receiving surface of the pressure receiving plate facing the outer surface of the panel is set wider than the pressing surface of the pressing claw facing the folded portion. Furthermore, the supporting wall for supporting the flexed part of the folded portion is formed in the pressure receiving plate. Thus, it is possible to perform hemming finishing of pressing and thereby bringing the folded portion accurately into close contact with the inner surface side of the panel by a simple manipulation of opening and closing the first and second holding arms while supporting the flexed part of the folded portion by using the supporting wall. Such an operation can therefore be performed efficiently without requiring a special skill. In addition, the pressure receiving surface of the pressure receiving plate facing the outer surface of the panel is set wider than the pressing surface of the pressing claw facing the folded portion. Accordingly, a pressure applied by the pressure receiving plate to the outer surface of the panel is dispersed into a wide area in the outer surface of the panel. Thus, it is possible to reduce a contact pressure acting on the outer surface of the panel to a lower level and to avoid scratches on the outer surface of the panel.

According to a second aspect of the present invention, in addition to the first aspect, the flexed part of the folded portion is formed into a tubular bead portion, and a relief recess is provided to the second holding arm at a position adjacent to the pressing claw, the relief recess being configured to cooperate with the supporting wall in receiving the bead portion when the pressing claw presses the folded portion.

According to the second aspect of the present invention, the flexed part of the folded portion is formed into the tubular bead portion. Meanwhile, the relief recess, which cooperates with the supporting wall in receiving the bead portion when the pressing claw presses the folded portion, is provided to the second holding arm at the position adjacent to the pressing claw. Thus, pressure from the pressing claw does not act on the bead portion so that the bead portion can retain its original shape.

According to a third aspect of the present invention, in addition to the first or second aspect, a supporting surface of the supporting wall facing the flexed part is formed into a curved surface projecting toward the flexed part.

According to the third aspect of the present invention, the supporting surface of the supporting wall facing the flexed part is formed into the curved surface that projects toward the flexed part. Thus, it is possible to slightly swing the hemming finishing pliers around a contact portion between the supporting wall and the flexed part. As a consequence, fine adjustment of a range of pressure application to the folded portion by the pressing claw can be achieved easily so that the hemming finishing can be conducted as desired.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described below with reference to the accompanying drawings.

Figure 1:
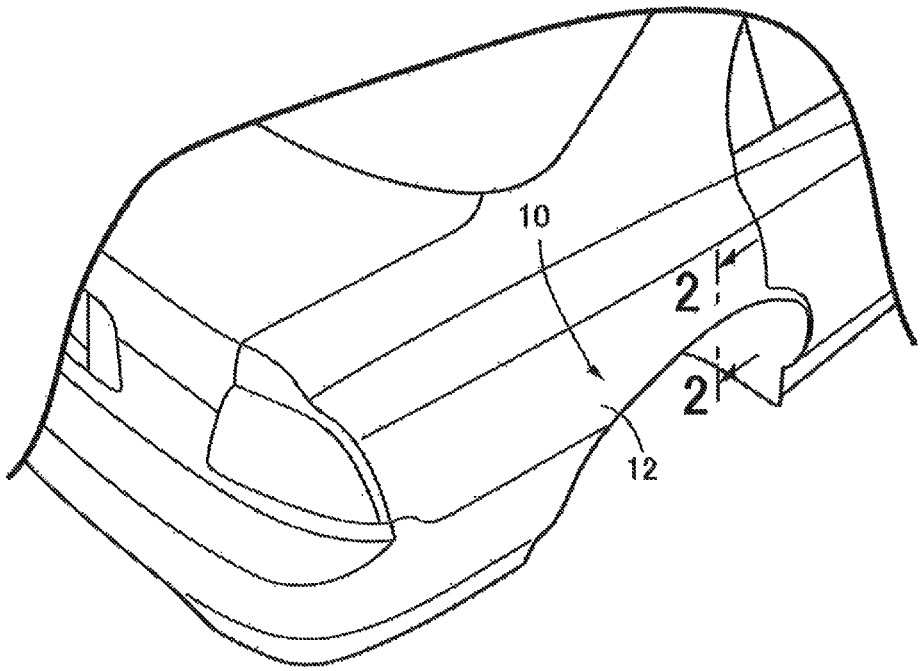
FIG. 1 is a perspective view of a rear fender portion of an automobile.
Figure 2:
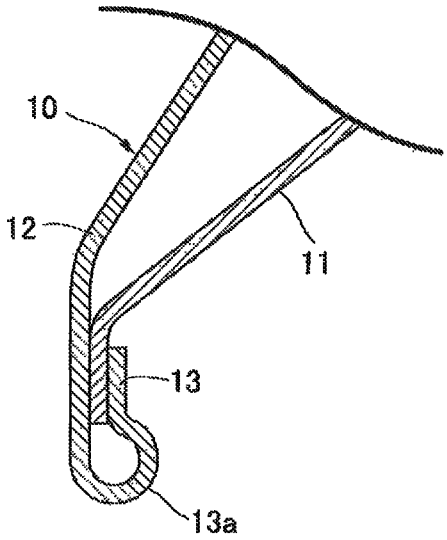
FIG. 2 is a sectional view taken along a 2-2 line in FIG. 1.

First, in FIG. 1 and FIG. 2, a rear wheel house unit 10 of an automobile includes a rear wheel house panel 11 and a rear fender panel 12 disposed on an outside of the rear wheel house panel 11. An end edge portion of the rear fender panel 12 is folded inward of a vehicle body in an arch portion of the rear wheel house unit 10, and an end edge portion of the rear wheel house panel 11 is clamped and held between the folded portion 13 and a body of the rear fender panel 12. Here, a tubular bead portion 13*a* is formed in a flexed part of the folded portion 13, whereby an end edge of the arch portion of the rear fender panel 12 is smoothened.

A process to be conducted in an automobile repair shop for joining a new rear fender panel 12, which is to replace an old part, to the rear wheel house panel 11 will be described with reference to FIGS. 3A to 3C.

Figure 3A:
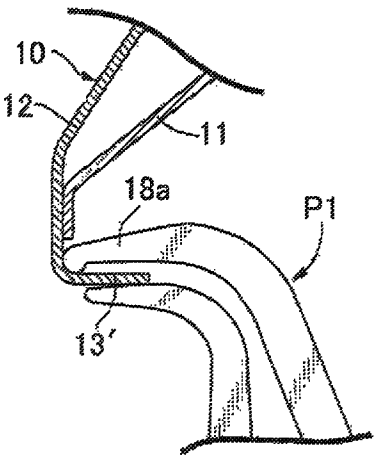
FIGS. 3A to 3C are views for explaining a repairing process of a rear fender panel.

As shown in FIG. 3A, a to-be-folded portion 13', which is flexed at substantially 90° inward of the vehicle body from the body of the rear fender panel 12, is formed in the arch portion of the rear fender panel 12 before being joined. The folded portion 13 is formed by strongly clamping the to-be-folded portion 13' with hemming pliers P1 so as to form the tubular bead portion 13*a* and bend the to-be-folded portion 13' toward the rear wheel house panel 11 as shown in FIG. 3B. Next, the folded portion 13 and the body of the rear fender panel 12 are strongly clamped by use of hemming finishing pliers P2 of the present invention while holding the rear wheel house panel 11 therebetween. Thus, the rear fender panel 12 is joined to the rear wheel house panel 11. Here, in order to strengthen joining between the rear fender panel 12 and the rear wheel house panel 11, it is preferable to coat bonding surfaces thereof with an adhesive. Meanwhile, in order to seal joined portions, it is preferable to coat a periphery of an end edge of the folded portion 13 with a sealing agent.

Next, the hemming finishing pliers P2 of the present invention will be described.

Constituents of the hemming finishing pliers P2 include first and second plier bodies 15, 16, which are connected together to be turnable relative to each other in mutually intersecting intermediate portions thereof by use of a pivot shaft 17. Meanwhile, one end sides of the first and second plier bodies 15, 16 constitute first and second holding arms 18, 19, respectively, while the other end sides thereof constitute respectively first and second handles 20, 21 for opening and closing the first and second holding arms 18, 19.

A pressure receiving plate 23 for supporting an outer surface of the rear fender panel 12 is fixed to a tip end portion of the first holding arm 18 by welding or the like. A pressing claw 25 for pressing the folded portion 13 to an inner surface side of the rear fender panel 12 supported by the pressure receiving plate 23, is formed in a tip end portion of the second holding arm 19.

The pressure receiving plate 23 is formed in such a way that a pressure receiving surface 23*a* facing the outer surface of the rear fender panel 12 becomes sufficiently wider than a pressing surface 25*a* of the pressing claw 25 facing the folded portion 13.

In addition, a supporting wall 24, which is flexed at 90° to the second holding arm 19 side so as to support the bead portion 13*a*, is formed at an inner end of the pressure receiving plate 23.

Moreover, a relief recess 26, which cooperates with the supporting wall 24 in receiving the bead portion 13*a* when the pressing claw 25 presses the folded portion 13, is provided to the second holding arm 19 at a position adjacent to the pressing claw 25.

Furthermore, a supporting surface 24*a* of the supporting wall 24 facing the bead portion 13*a* is formed into a curved surface that projects toward the bead portion 13*a*. To be more precise, a curvature radius R1 of the curved supporting surface 24*a* is set smaller than a curvature radius R2 of the arch portion of the rear fender panel 12.

Next, operation of the embodiment will be described.

Figure 3B:
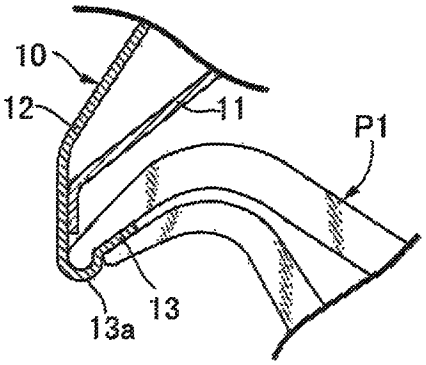

As shown in FIG. 3B, after the folded portion 13 in which the flexed part is formed into the tubular bead portion 13*a* is made in the end edge portion of the rear fender panel 12 by use of the hemming pliers P1, the folded portion 13 is subjected to the hemming finishing by using the hemming finishing pliers P2 of the present invention as follows.

Figure 3C:
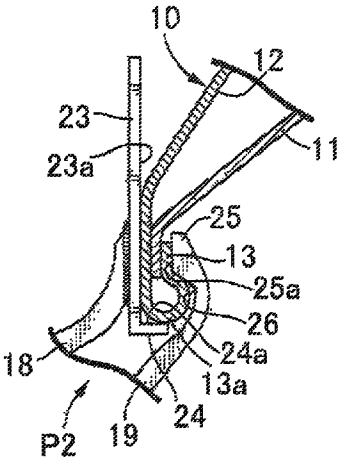
Figure 4:
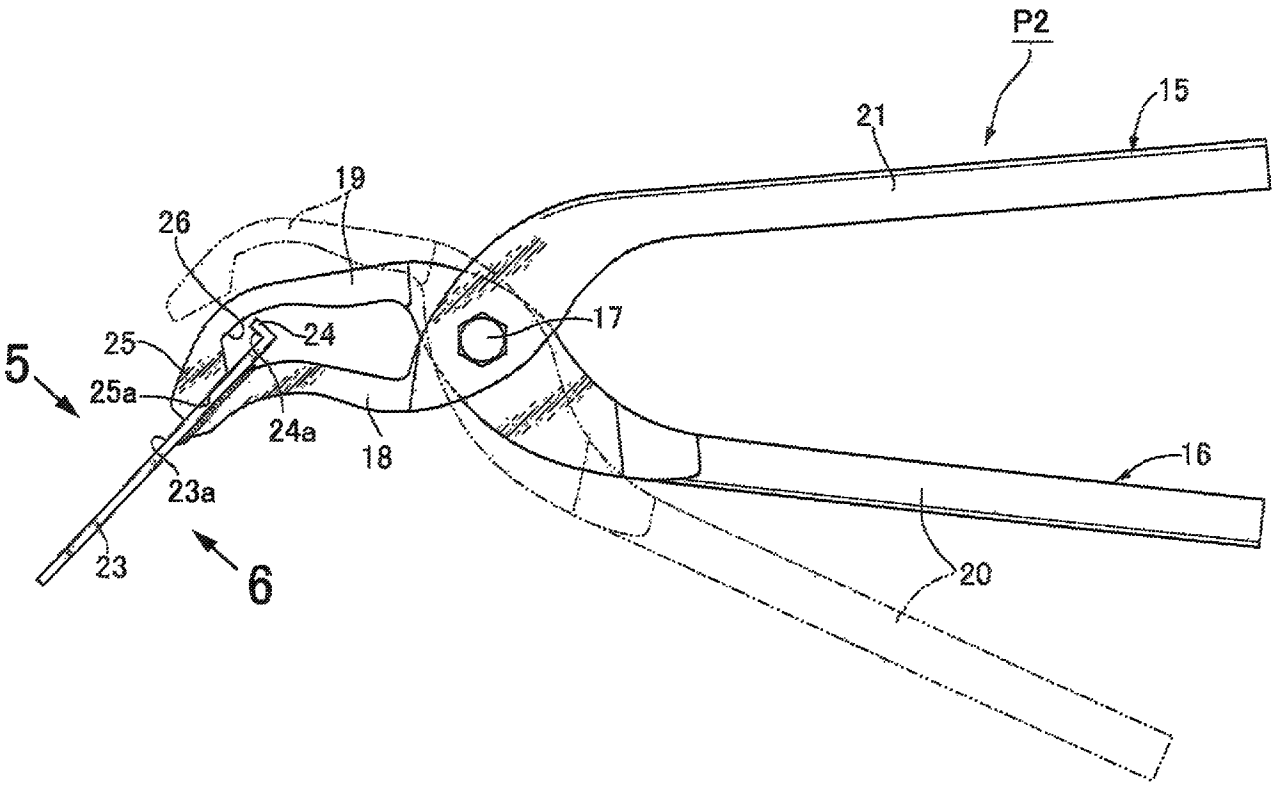
FIG. 4 is a side view of hemming finishing pliers according to the present invention.
Figure 5:
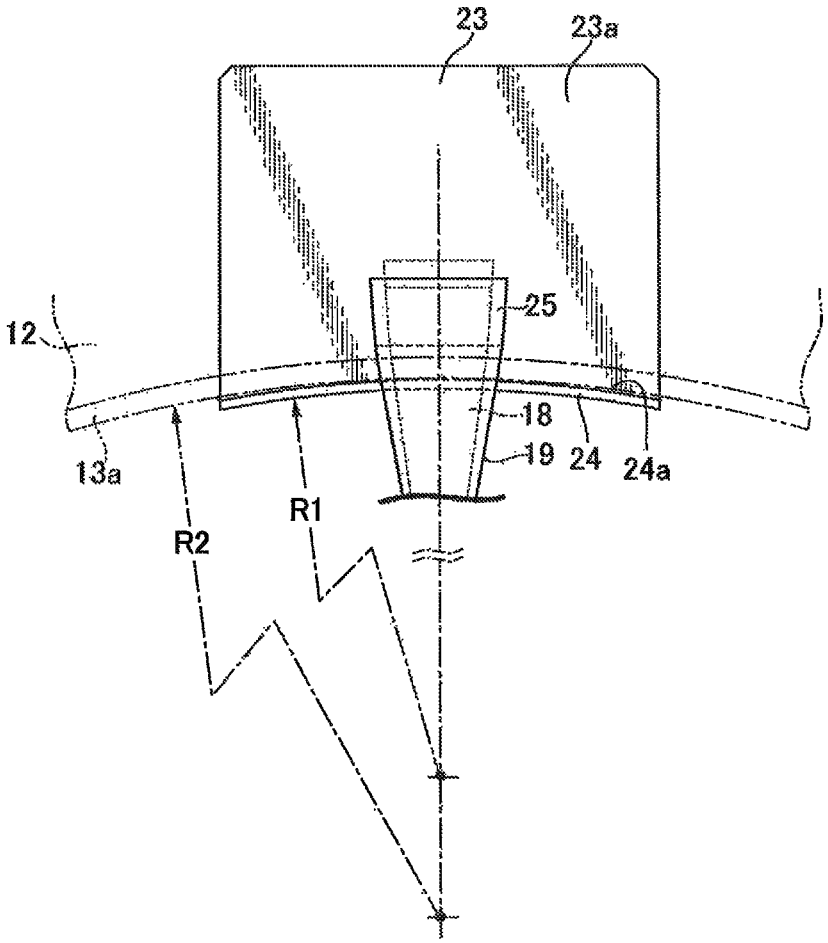
FIG. 5 is a view as seen in a direction of an arrow 5 in FIG. 4.
Figure 6:
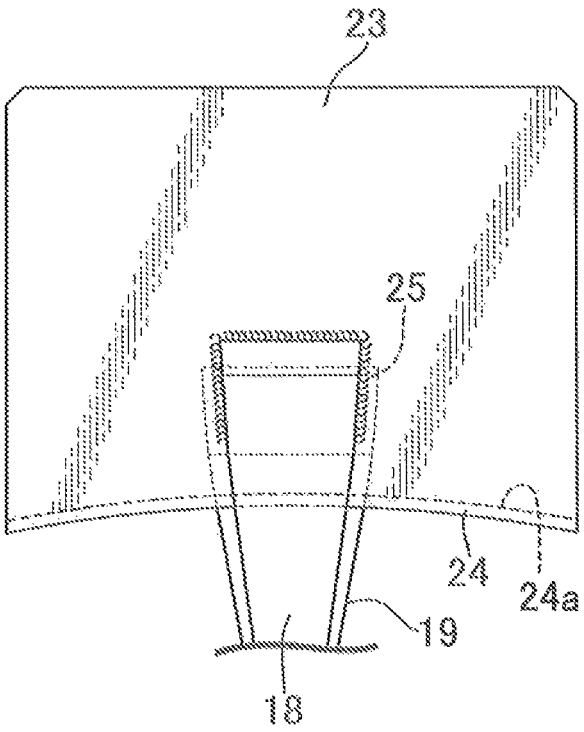
FIG. 6 is a view as seen in a direction of an arrow 6 in FIG. 4.

Specifically, as shown in FIG. 3C, firstly, in a state where the first and second holding arms 18, 19 of the hemming finishing pliers P2 are opened widely, the pressure receiving plate 23 of the first holding arm 18 is brought into contact with the outer surface of the rear fender panel 12, and meanwhile, the bead portion 13*a* is supported by using the supporting wall 24. Subsequently, the first and second holding arms 18, 19 are closed by tightly gripping the first and second handles 20, 21. Thus, the folded portion 13 is pressed against the pressure receiving plate 23 by using the pressing claw 25 of the second holding arm 19, and the folded portion 13 is brought into close contact with the inner surface of the rear fender panel 12 together with an end edge portion of the rear wheel house panel 11. As described above, it is possible to perform the hemming finishing to press and thereby bring the folded portion 13 accurately into close contact with the inner surface side of the rear fender panel 12 by the simple manipulation of opening and closing the first and second holding arms 18, 19 while supporting the flexed part of the folded portion 13, that is, the bead portion 13*a*, by using the supporting wall 24. Such an operation can therefore be performed efficiently without requiring a special skill.

In addition, the pressure receiving surface 23*a* of the pressure receiving plate 23 facing the outer surface of the rear fender panel 12 is set sufficiently wider than the pressing surface 25*a* of the pressing claw 25 facing the folded portion 13. Accordingly, the pressure applied by the pressure receiving plate 23 to the outer surface of the rear fender panel 12 is dispersed into a wide area in the outer surface of the rear fender panel 12. Thus, it is possible to reduce a contact pressure acting on the outer surface of the rear fender panel 12 to a lower level and to avoid scratches on the outer surface of the rear fender panel 12.

Moreover, the relief recess 26 which cooperates with the supporting wall 24 in receiving the bead portion 13*a* is provided to the second holding arm 19 at the position adjacent to the pressing claw 25. Accordingly, pressure from the pressing claw 25 does not act on the bead portion 13*a* so that the bead portion 13*a* can retain its original shape.

Furthermore, the supporting surface 24*a* of the supporting wall 24 facing the bead portion 13*a* is formed into the curved surface that projects toward the bead portion 13*a*. Accordingly, it is possible to slightly swing the hemming finishing pliers P2 around a contact portion between the supporting wall 24 and the bead portion 13*a*. As a consequence, fine adjustment of a range of pressure application to the folded portion 13 by the pressing claw 25 can be achieved easily so that the hemming finishing can be conducted as desired.

The above-described hemming finishing is performed on an entirety of the arch portion of the rear fender panel 12. Thus, the joining of the rear fender panel 12 to the rear wheel house panel 11 is completed.

Note that the present invention is not limited only to the above-described embodiment but various design changes are possible within the range not departing from the gist of the invention. The hemming finishing pliers P2 of the present invention are also applicable to a case of performing the hemming finishing on various panels other than panels constituting a vehicle body of an automobile.

What is claimed is:

1. Hemming finishing pliers comprising:

First and second plier bodies connected together to be turnable relative to each other in mutually intersecting intermediate portions thereof by use of a pivot shaft, the first and second plier bodies including:

first and second holding arms formed on one-end sides of the first and second plier bodies, and first and second handles formed on opposite-end sides of the first and second plier bodies and configured to open and close the first and second holding arms, in which the pliers are configured to press and thereby bring a folded portion of a panel into close contact with an inner surface side of the panel facing the folded portion, by a clamping action of the first and second holding arms, wherein:

a pressure receiving plate for supporting an outer surface of the panel is provided in a tip end portion of the first holding arm, a pressing claw, for pressing the folded portion against the panel supported by the pressure receiving plate, is provided in a tip end portion of the second holding arm, the pressing claw including a pressing surface having a first width, the pressing surface configured for placement facing the folded portion, a pressure receiving surface of the pressure receiving plate, configured for placement facing the outer surface of the panel, has a second width that is set wider than the first width of the pressing claw's pressing surface, a supporting wall, for supporting a tubular bead portion of the folded portion is formed on the pressure receiving plate, the supporting wall extending substantially continuously across substantially the entire width of the pressure receiving plate and being configured to position the pressure receiving surface relative to the tubular bead portion when the folded portion is received on the pressure receiving surface, and relief recess is provided in the second holding arm at a position adjacent to the pressing claw, the relief recess being disposed in a space between the pressing claw and the supporting wall, the relief recess further being configured to receive the tubular bead portion therein when the pressing claw presses the folded portion against the pressure receiving surface, and further wherein a supporting surface of the supporting wall, configured for placement facing the tubular bead portion, is formed as a curved surface having a radius of curvature along its width having a center of curvature that lies on the central axis of the pressing claw's pressing surface when the pressing surface is in contact with the pressure receiving surface.

* * * * *